United States Patent [19]

Switall

[11] Patent Number: 4,932,319

[45] Date of Patent: Jun. 12, 1990

[54] SPRAY DAMPENING SYSTEM FOR OFFSET PRESS

[75] Inventor: Thomas G. Switall, Wheeling, Ill.

[73] Assignee: Ryco Graphic Manufacturing, Inc., Wheeling, Ill.

[21] Appl. No.: 263,036

[22] Filed: Oct. 26, 1988

[51] Int. Cl.[5] ..... B41L 23/04

[52] U.S. Cl. ..... 101/147; 29/132

[58] Field of Search ..... 101/147, 148; 29/132

[56] References Cited

U.S. PATENT DOCUMENTS

| | | | |
|---|---|---|---|
| 2,429,390 | 10/1947 | Case | 60/539 |
| 3,130,602 | 4/1964 | Nigrelli et al. | 74/593 |
| 3,983,812 | 10/1976 | Schramm | 101/349 |
| 3,994,222 | 11/1976 | Pullen | 101/349 |
| 4,064,801 | 12/1977 | Switall | 101/147 |
| 4,088,074 | 5/1978 | Dahlgren et al. | 101/350 |
| 4,385,559 | 5/1983 | Jarach | 101/148 |
| 4,515,078 | 5/1985 | Diffipp | 101/157 |
| 4,649,818 | 3/1987 | Switall et al. | 101/147 |
| 4,708,058 | 11/1987 | Smith | 101/147 |
| 4,794,680 | 1/1989 | Meyerhoff et al. | 29/132 |

*Primary Examiner*—Edgar S. Burr
*Assistant Examiner*—Ren Yan
*Attorney, Agent, or Firm*—Thomas E. Smith

[57] ABSTRACT

The disclosed dampening system employs rolls which are frictionally driven by the plate roll of an offset printing press to distribute a dampening fluid over the surface of the plate roll. The system employs a rubber form roll which is in frictional engagement with the peripheral surface of the plate roll and is thus frictionally driven by the plate roll. A water feed roll having a ceramic surface is in frictional engagement with the form roll so that the feed roll will be frictionally driven by the form roll. Dampening fluid is sprayed onto the surface of the feed roll by spray nozzles, flickers or slingers, and the feed roll is axially reciprocated relative to the form roll while it is being frictionally driven by the form roll and while the dampening fluid is being applied to its surface so that the dampening fluid will be transferred to and distributed over the surface of the form roll by the feed roll and will in turn be transferred to and distributed over the surface of the plate roll by the form roll.

3 Claims, 1 Drawing Sheet

SPRAY DAMPENING SYSTEM FOR OFFSET PRESS

BACKGROUND OF THE INVENTION

This invention relates to a spray dampening system for offset printing presses, and more particularly to a spray dampening system which may be retrofitted on existing offset presses or incorporated into offset press designs and frictionally driven by the plate roll or cylinder. As used herein the term "spray" is intended to include any finely divided form whether in a mist or droplets. The "spraying" may be by means of nozzles or by means of flicker brushes or slinger discs or the like which are well known means for applying the damping fluid to a feed roll.

In the present spray dampening systems for offset printing presses, the dampening fluid is frequently introduced into the ink train usually by spraying directly onto the ink roll or onto dampening rolls which transfer the dampening fluid to the rolls of the ink train. The dampening fluid and ink are thus transferred together to the plate roll and portions of the plate roll are coated with the water-based dampening fluid while the ink is coated on the other portions. In this type of system the dampening and ink rolls are both geared to the printing press rolls.

It is many times preferable to apply the ink and the dampening fluid separately, however, since there is a more even distribution of each. Systems which employ separate ink and dampening fluid trains also are geared to and driven by the press roll drive. The problem is that it is very difficult to retrofit a spray dampening system onto an existing printing press because there is limited room and because it is difficult to gear or otherwise drivingly connect the dampening rolls to the printing press. Heretofore any such dampening system required gearing or belts to tie the dampening system into the printing press drive so that both could be operated at the same speed. Very little effort was made to create a satisfactory frictional drive because of the belief that excessive plate wear would result or inadequate dampening fluid distribution would occur. The object of the spray dampening system is to provide an even distribution of dampening fluid over the surface of the plate cylinder, and it was heretofore believed that it was not possible to achieve this even distribution while providing the frictional engagement necessary to drive the spray dampening system rolls.

Moreover, it has been found that for even distribution, it is desirable to axially reciprocate the water feed rolls. However this adds another obstacle to a satisfactory friction drive system because such axial movement of one roll relative to the other requires axial surface slippage, while for proper frictional drive, the surface slippage, at least in the direction of rotation, should be minimized.

It is an object of this invention to provide a system which can be retrofitted onto existing printing presses and with the distribution roll being frictionally driven by the plate roll of the printing press. By proper selection of the roll materials, axial movement of one roll relative to the other may be accomplished to provide an even distribution of the dampening fluid but the frictional engagement between the rolls will be maintained so that both rolls of the spray dampening system may be driven by friction engagement between one of the rolls and the plate roll of the press.

SUMMARY OF THE INVENTION

The spray dampening system constructed in accordance with this invention distributes a dampening fluid over the surface of the plate roll of an offset printing press. The system comprises a form roll having an elastomeric surface in frictional engagement with the peripheral surface of the plate roll, whereby the form roll will be frictionally driven by the plate roll. A feed roll is provided having a ceramic surface in frictional engagement with the elastomeric surface of the form roll, whereby the feed roll will be frictionally driven by the form roll. Means in the form of conventional spraying heads spray dampening fluid onto the surface of the feed roll, and means preferably in the form of a hydraulic valve and one or more piston cylinders axially reciprocate the feed roll relative to the form roll while it is being frictionally driven by the form roll and while dampening fluid is being sprayed onto its surface. Thus dampening fluid will be transferred to and distributed over the surface of the form roll by the feed roll and will be transferred and distributed over the surface of the plate roll by the form roll.

DETAILED DESCRIPTION OF THE PREFERRED EMBODIMENT

Figures 1, 2, 3:
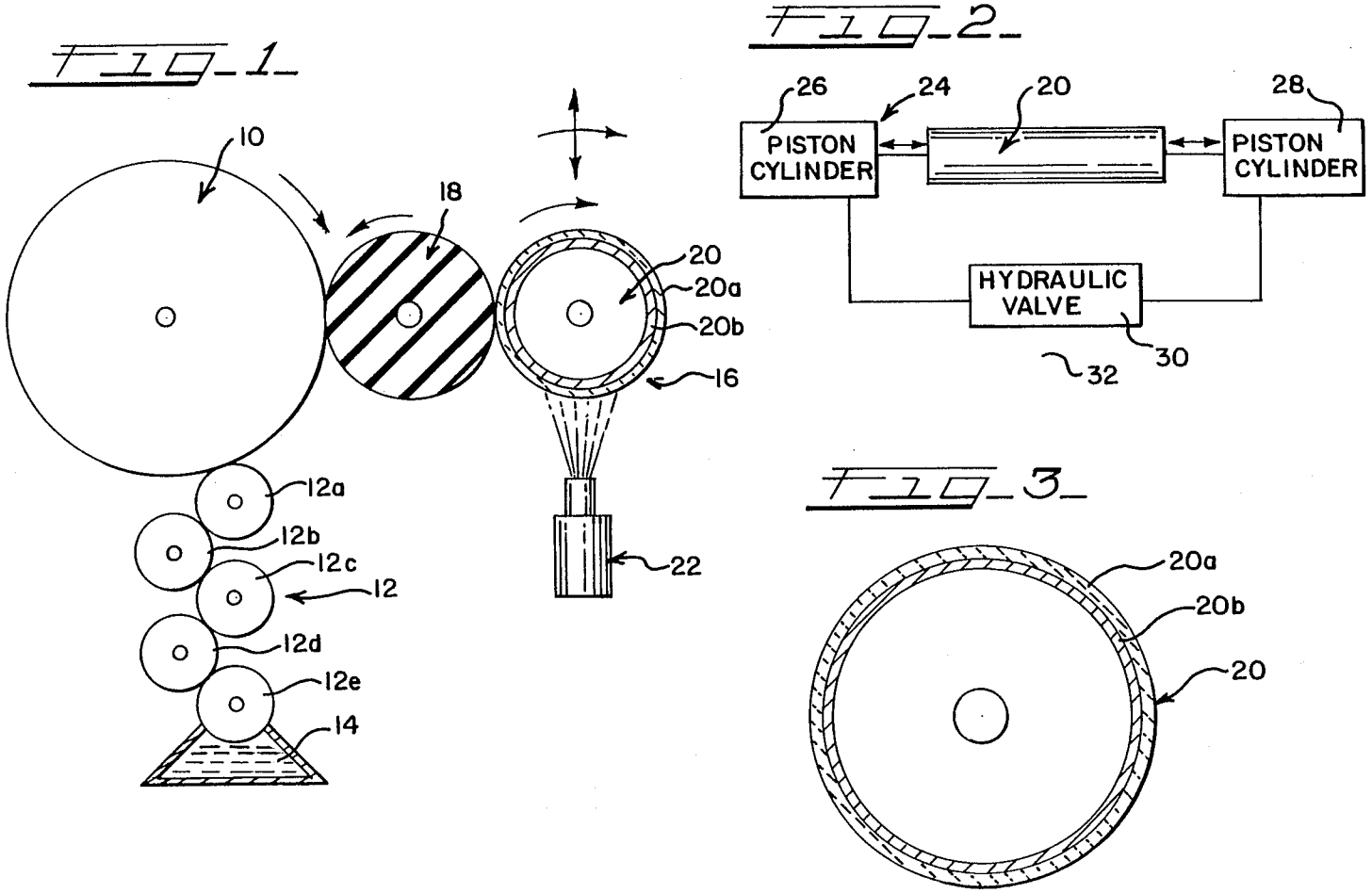
FIG. 1 is a schematic illustration of a spray dampening system constructed in accordance with this invention showing a plate cylinder, an ink train, and a spray dampening system consisting of an elastomeric form roll, a ceramic feed roll, and a spray nozzle for spraying dampening fluid onto the surface of the feed roll.
FIG. 2 is a schematic illustration showing the manner in which the feed roll may be axially reciprocated employing the hydraulic valve and a hydraulic piston cylinder on either side of the feed roll.
FIG. 3 is a cross sectional view of the feed roll showing the ceramic coating on the steel substrate.

The spray dampening system constructed in accordance with this invention is adapted to be retrofitted onto existing offset printing equipment or incorporated into offset press designs. In FIG. 1, there is illustrated a plate cylinder 10 of an offset printing press, an ink train 12, consisting of five rollers 12*a*, 12*b*, 12*c*, 12*d*, and 12*e*, transfers ink from an ink source 14 to the plate cylinder 10.

It is desirable to have the dampening fluid, which is a water-based solution, delivered to the surface of the plate roll 10 fine droplets or mist form such as by spraying or flicking. This may be done ahead of the delivery of ink by the ink train 12. To accomplish this, the dampening system 16 comprises a form roll 18, a feed roll 20, a spraying mechanism 22, and a roll shifting mechanism 24, illustrated in FIG. 2, to axially reciprocate the feed roll relative to the form roll. In the present disclosure, a spraying mechanism is used but it will be understood that other types of droplet or mist forming mechanisms, such as flickers or spiral brushes may be used.

In this system, the form roll 18 is frictionally driven by the plate cylinder 10 of the printing press and the feed roll 20 is frictionally driven by the form roll. In this connection, great care must be taken that the frictional engagement between the form roll and the plate roll or cylinder of the printing press not be such as to wear the plate out. Nevertheless, the frictional engagement must be such that the plate roll 10 will drive the form roll 18 and the form roll 18 will in turn drive the feed roll 20. In the illustrated embodiment, the form roll 18 is constructed of rubber or other elastomeric material having a Durometer hardness of in the range of 20 to 50 Shore A. It has been found that if the hardness of the roll is less, that is, below 20 Shore A Durometer hardness, the roll will slip and there will not be a proper transfer of dampening fluid from the form roll 18 to the plate roll 10. If, however, the form roller has a hardness of greater than about 50 Durometer, there will be a danger of excessive wear of the plate on the plate roll 10. In essence, the form roll must be hard enough to be driven by the plate roll 10 yet soft enough that it will not wear the plate on the plate roll out. It is preferred that the hardness of the form roll be in the range of 35 to 45 Shore A durometer.

The feed roll 20 has a ceramic surface coating 20*a* on a steel substrate 20*b*. It is preferred that the ceramic coating be a plasma-sprayed type coating of an aluminum oxide ($Al_2O_3$) and titanium dioxide ($TiO_2$) having a roughness or surface finish of in the range of about 110 to about 140 Ra, with about a 125 Ra finish being preferred. This particular coating material is quite hard being in the range of about 60 to about 63 Rockwell C. The alumina/titania ceramic provides a hydrophylic surface for the feed roll 20 so that the water based dampening fluid will spread evenly across the surface of the feed roll. It may also be desirable to have the feed roll surface be the kind that repels ink.

The surface finish of the feed roll is important. If smoother than about 110 Ra, excessive slippage can occur; if rougher than about 140 Ra, excessive wear of the form roll and friction can occur. The micro-hardness range of about 60 to about 63 Rc is preferred for purposes of maintaining the roughness of the feed roll surface over long periods of use.

The feed roll is axially oscillated preferably on the order of three-quarters of an inch total axial travel. This assures even spreading and distribution of the water based dampening fluid over the surface of the form roll 18 and eliminates the possibilities of streaking caused by water channeling.

The mechanism 24 for axially reciprocating the feed roll relative to the form roll is schematically illustrated in FIG. 2 and employs two piston cylinders, 26 and 28, the pistons of which are connected to the journals on either side of the feed roll 20. The piston cylinders 26 and 28 are connected to a power drive mechanism which in the illustrated embodiment is a hydraulic valve 30 which in turn is connected by means of a conduit 32 to a source of hydraulic pressure (not shown). The hydraulic valve 30 is preferably the type which will reverse automatically when the piston of the piston cylinder which is being driven reaches the end of its stroke. At the end of each stroke the pressure in the valve builds up to above that required to move the piston to the end of its stroke and this build up of pressure in the valve causes the valve to automatically reverse, releasing the pressure in the one piston cylinder and applying the pressure to the other piston cylinder, thereby causing the feed roll 20 to move axially in the opposite direction. Such an automatic directional valve is a commonly available valve. It will be appreciated that various other means can be employed for oscillating the feed roll 20 while it is being rotated.

The mechanism 22 for spraying the dampening fluid onto the surface of the feed roll 20 may, for example, be the same mechanism as described and illustrated in U.S. Pat. No. 4,649,818 in which the solenoid operated spray dampening fluid nozzles are operated at a frequency in accordance with the speed of the press. Various other types of spray mechanisms may be used for delivering the dampening fluid in a spray (i.e. droplet or mist form) to the ceramic surface 20*a* of the feed roll 20.

The composition and finish of the ceramic surface 20*a* of the feed roll 20 together with the composition and hardness range of the surface of the rubber form roll 18 provides a very unique type of spray dampening system which can be retrofitted into an existing press as a unit and totally friction driven. Thus, it is not necessary to independently drive the dampening system by gear or belts timed to the speed of the press. Rather the speed of the dampening system rolls will be operated in accordance with the speed of the press because it is friction driven by the plate roll 10 of the press. If the rubber form roll 18 is maintained in the hardness range of 20 to 50 Shore A Durometer, this will permit the rolls to be friction driven by the plate roll 10 without damaging the plate yet the feed roll in this hardness range is hard enough to prevent the water from hydroplaning through and causing streaking. Moreover in this hardness range the feed roll 20 may be axially moved relative to the form roll 18 while still maintaining the proper frictional drive by rotation of the surface of the form roll in frictional contact with the ceramic surface 20*a* of the feed roll.

The foregoing disclosure has been given only by way of example and it will be apparent to those skilled in the art that various modifications may be made in the embodiment disclosed without departing from the spirit and scope of the invention.

What is claimed is:

1. In a spray dampening system for distributing a dampening fluid over the surface of a plate roll a form roll having an elastomeric surface in frictional engagement with the peripheral surface of the plate roll, whereby the form roll will be frictionally driven by said plate roll; a feed roll having a hydrophylic ceramic surface in frictional engagement with the elastomeric surface of said form roll, whereby the feed roll will be frictionally driven by said form roll and the dampening fluid will spread evenly across the surface of said feed roll, means for applying dampening fluid to the surface of said feed roll, and means for axially reciprocating said feed roll relative to said form roll while it is being frictionally driven by said form roll and while dampening fluid is being applied to its surface, the surface finish of said feed roll being between about 110 Ra and 140 Ra, whereby said feed roll may axially slide relative to said form roll while it is simultaneously being frictionally driven by said form roll, whereby the dampening fluid will be transferred to and distributed over the surface of said form roll by said feed roll and will be transferred to and distributed over the surface of the plate roll by said form roll.

2. The spray dampening system of claim 2 wherein said elastomeric surface of said form roll is rubber.

3. The spray dampening system of claim 1 wherein the ceramic surface of said feed roll comprises aluminum oxide and titanium dioxide.

* * * * *